United States Patent [19]

Polselli et al.

[11] 4,200,317

[45] Apr. 29, 1980

[54] DOOR FASTENER

[76] Inventors: Luigi Polselli; Rudolph Polselli, both of 8 Groce Ave., Glenolden, Pa. 19036

[21] Appl. No.: 915,781

[22] Filed: Jun. 15, 1978

[51] Int. Cl.[2] ..... E05C 19/00

[52] U.S. Cl. ..... 292/293; 70/14

[58] Field of Search ..... 292/297, 298, 294, 295, 292/296, DIG. 9, 293; 70/14

[56] References Cited

U.S. PATENT DOCUMENTS

| | | | |
|---|---|---|---|
| 980,498 | 1/1911 | Day | 292/293 |
| 1,057,277 | 3/1913 | Rogers | 292/293 |
| 1,073,238 | 9/1913 | Huston | 292/293 |
| 1,477,731 | 12/1923 | Ulrich | 292/294 |
| 1,627,709 | 5/1927 | Menchen | 292/293 X |
| 2,161,673 | 6/1939 | Hammond | 292/294 |
| 2,562,301 | 7/1951 | Dorion | 292/293 |
| 2,692,631 | 10/1954 | Andersson | 248/226.4 X |
| 3,257,137 | 6/1966 | Von Duyke | 292/298 |
| 3,423,968 | 1/1969 | Foote | 70/14 |

FOREIGN PATENT DOCUMENTS

| | | | |
|---|---|---|---|
| 855950 | 11/1970 | Canada | 70/14 |
| 1185078 | 3/1970 | United Kingdom | 70/14 |

*Primary Examiner*—J. Franklin Foss

*Attorney, Agent, or Firm*—Weiser, Stapler & Spivak

[57] ABSTRACT

A portable door fastener is disclosed which includes a body of thin, sturdy material which can be inserted between a door and a door jamb and which includes a projection to engage in the jamb latch recess. The rearward end of the thin body is provided with a threaded block through which a partially threaded operating bolt is longitudinally movable. The operating bolt forwardly attaches to a pressure plate, which plate is in sliding engagement with the body. The operating bolt terminates rearwardly in a handle which is used to turn the bolt through the threaded block to force the pressure plate against the door to prevent relative movement between the door and the door jamb.

3 Claims, 5 Drawing Figures

FIG. 3
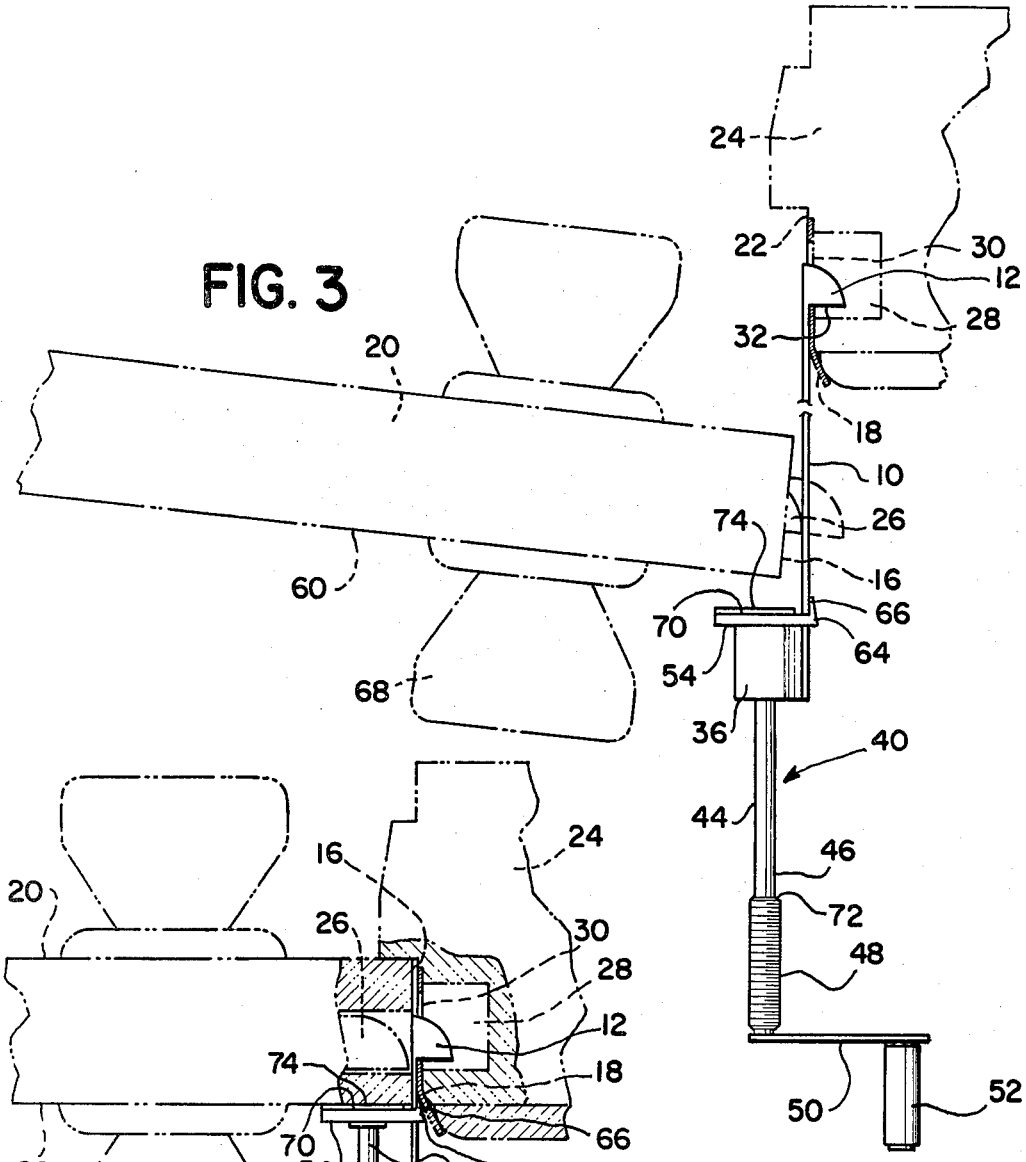
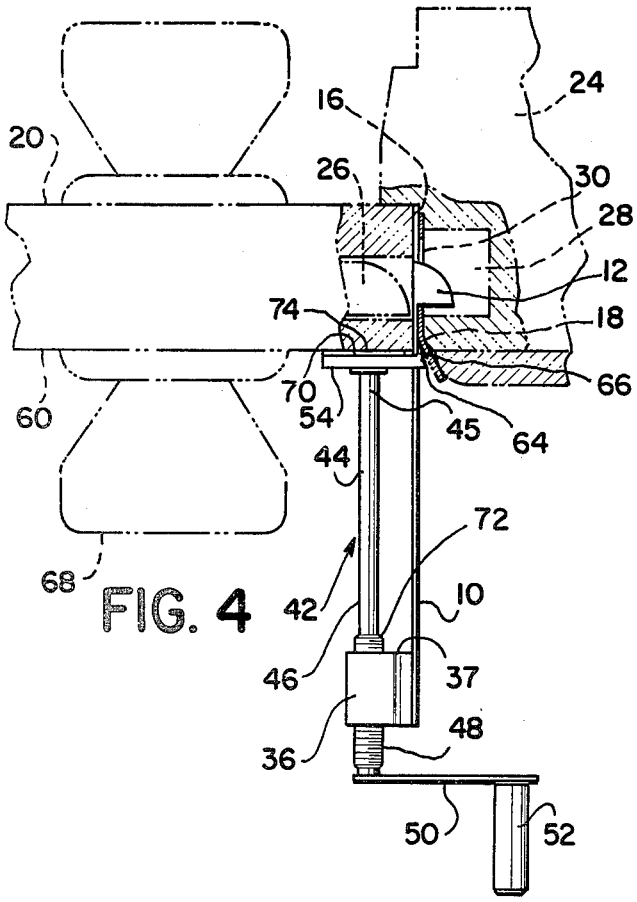
FIG. 4
FIG. 5
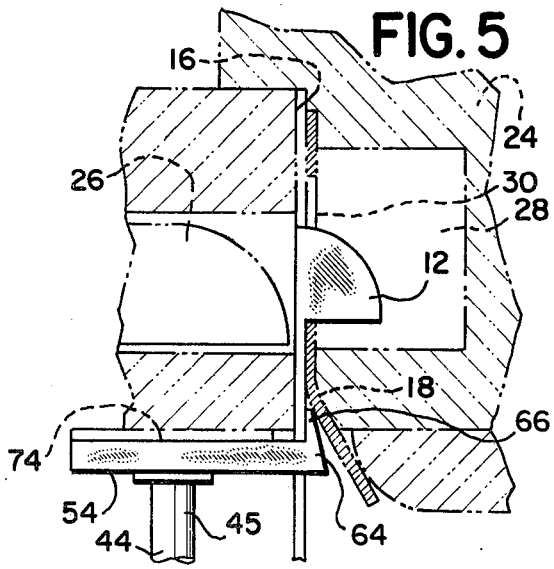

DOOR FASTENER

BACKGROUND OF THE INVENTION

The invention relates generally to a door fastener, and more particularly, is directed to portable fastener including an operating bolt designed to permit rapid locking and unlocking of most door constructions.

It has become increasingly important to find reliable means to lock doors in homes and businesses to discourage unlawful entry and to protect persons and property. In the case of hotels and motels, the need for better security systems has been well publicized. See for example the article appearing on page 48 of the Wall Street Journal edition of May 25, 1978 entitled "Hotel Officials, Worried About In-House Crime, Act to Tighten Security and Improve Door Locks."

Prior workers in the art have developed portable door fasteners of the general type comtemplated by the present invention in an effort to provide a convenient, inexpensive, trouble-free method of locking a door from the inside. For example, in U.S. Pat. No. 2,161,673, a door fastener is disclosed which comprises a blade having a bolt suitable for insertion into the recess provided in the door jamb. A block is urged into contact with the door by turning a screw through a finger-piece.

In U.S. Pat. No. 1,477,731, a similar type of locking device has been shown which includes a locking blade having integral hooks for insertion into the jamb keeper space. A screw extension extends rearwardly and adjustably carries a yoke member.

While all of the above-mentioned prior art patents teach devices of the same nature and same general operating concept as employed in the present invention, it will be noted that all of the prior art devices of which we are aware are relatively slow in operation and include operating bolts which are threaded throughout the length for adjustment and locking purposes.

SUMMARY OF THE INVENTION

The present invention relates generally to a portable door fastener device, and in particular, relates to an interior door locking device having a slide body including a gripper projection for securing into the latch space, a pressure plate movable along the slide body by threaded and unthreaded means to provide extremely quick application and removal of the door fastener relative to the door and jamb.

The door fastener of the present invention comprises generally a thin, strong, elongated, flat slide body which terminates forwardly in a pair of vertically spaced grippers or fingers which are configured to insert into the recess defined in the door jamb by the usual lock keeper. The rearward end of the slide body is provided with a threaded socket which projects oppositely from the grippers. The socket may be integrally formed with the slide body or may be securely affixed thereto in known manner, such as by welding or brazing. The socket is suitably threaded to receive therein the operating bolt or adjusting bolt, which in the present application, comprises the threaded and unthreaded means.

The adjusting bolt of the present invention is partially threaded at the rearward end thereof and is partially unthreaded at the forward end thereof whereby the unthreaded section may be moved through the threaded socket without restriction to speed up the door fastener application and removal procedures. The threaded end of the adjusting bolt can be threadedly engaged within the socket when it is desired to utilize the door fastener to lock the door in a closed position. A handle connects to the rearward terminus of the adjusting bolt to facilitate rotation of the adjusting bolt within the threaded socket.

The adjusting bolt or operating bolt forwardly connects to a pressure plate in a suitable bearing connection whereby the adjusting bolt can be rotated relative to the pressure plate when the rearwardly positioned handle is rotated. The pressure plate is a sliding fit upon the slide body and includes a stop surface which is brought into face-to-face contact with a portion of the door interior surface when it is desired to lock the door in the closed position. The pressure plate includes a bottom thin toe plate which terminates forwardly in a knife edge to facilitate insertion of the toe plate into the space defined between the edge of the door and the door jamb without damage to the existing construction members.

The unthreaded portion of the adjusting bolt allows the bolt to slide in longitudinal relationship through the threaded socket without engaging the threads whereby the pressure plate may be quickly brought substantially into initial contact with the surface of the door without requiring rotation of the bolt by the operating handle. In this manner, the device may be quickly adapted to secure doors of varying thicknesses in a speedy manner, thereby rendering the door fastener rapidly universal in operation with most doors of usual thicknesses. By moving the unthreaded barrel of the adjusting bolt forwardly through the threaded socket until the pressure plate initially contacts the door surface, the initial slack is rapidly taken up, thereafter allowing the threaded portion of the adjusting bolt to threadedly engage the threaded socket to employ the mechanical advantage of the screw thread when tightening the pressure plate against the door to maintain the door in the locked position.

It is therefore an object of the present invention to provide an improved door fastener of the type set forth.

It is another object of the present invention to provide a novel door fastener including a flat, elongated slide body, a means to removably retain the forward portion of the slide body in association with the door jamb strike plate, a pressure plate slidable relative to the slide body to retain the door in the closed position and adjusting bolt means to urge the slide forwardly into contact with the door.

It is another object of the present invention to provide a portable door lock or fastener with relatively small dimensions which may be carried about by a traveler to employ the device as an additional door securing lock.

It is another object of the present invention to provide a door fastener which is adapted to be utilized on doors opening inwardly and is applied to the door in engagement with the door jamb and the door to prevent relative movement therebetween.

It is another object of the present invention to provide a door fastener of the type that may be readily attached to a door and jamb and that may be readily detached therefrom without the use of fasteners, keys, tools or other securing objects.

It is another object of the present invention to provide a novel door fastener that is simple in design, lightweight in construction and trouble-free when in use.

Other objects and a fuller understanding of the invention will be had by referring to the description and claims of a preferred embodiment thereof, taken in conjunction with the accompanying drawings, wherein like reference characters are employed to designate similar parts throughout the several views and in which:

BRIEF DESCRIPTION OF THE DRAWINGS

FIG. 3 is a side elevational view showing the door fastener installed in an initial position prior to securely locking a door.

FIG. 4 is a view similar to FIG. 3, showing the door fastener in the position to securely lock a door.

FIG. 5 is an enlarged, partial, side elevational view showing details of the locking parts of the fastener in the position illustrated in FIG. 4.

DESCRIPTION OF THE PREFERRED EMBODIMENT OF THE INVENTION

Figure 1:
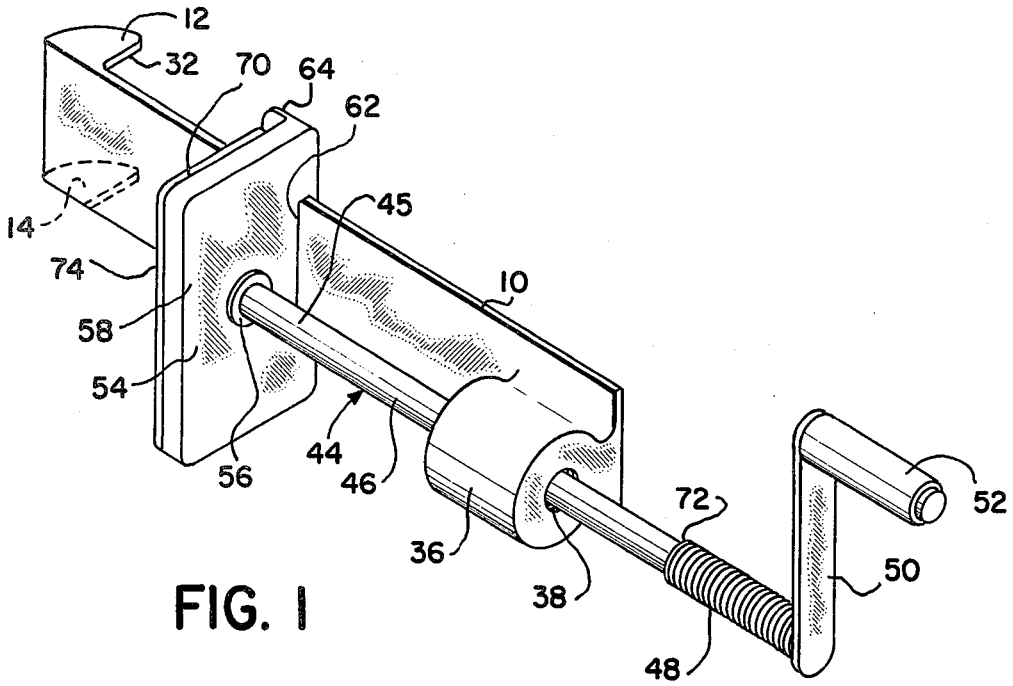
FIG. 1 is a front perspective view of the door fastener constructed in accordance with the present invention.

Although specific terms are used in the following description for the sake of clarity, these terms are intended to refer only to the particular structure of the invention selected for illustration in the drawings, and are not intended to define or limit the scope of the invention.

Figure 2:
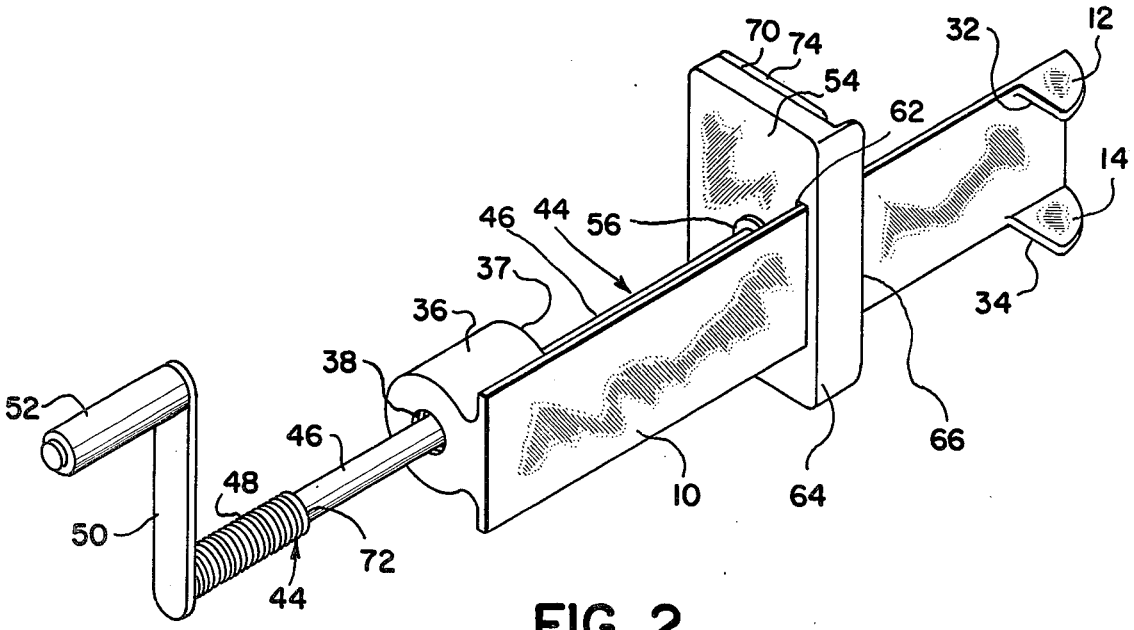
FIG. 2 is a rear perspective view of the door fastener.

Referring now to the drawings, as best seen in FIGS. 1 and 2, the door fastener of the present invention comprises generally a planar, strong, thin slide body 10 which is of sufficient length to permit the device to be utilized with existing door constructions without binding upon the front edge 16 of a door 20 when installing and removing the device. Preferably, the slide body 10 can be constructed of hardened tool steel, such as a steel composition suitable for the fabrication of tools or springs, with thickness on the order of approximately 1/16th of an inch to readily fit within the space defined between the front edge 16 of a door 20 and the face 22 of the associated door jamb 24.

The slide body 10 terminates forwardly in a pair of forwardly projecting grippers 12, 14, which grippers are spaced apart a sufficient distance to provide stability within the usual recess or opening 26 provided for the door latch 28 and to easily fit within the opening 30 formed in the conventional metallic jamb strike plate 18. The grippers 12, 14 terminate rearwardly in respective locking faces 32, 34 which project at right angles from the plane of the slide body 10 for door securing purposes, as hereinafter more fully set forth.

Rearwardly positioned on the slide body 10 is an integral, rigidly affixed block or socket 36 which is provided with internal threads 38 in longitudinal alignment with the longitudinal extension of the body 10. It will be noted that the grippers 12, 14 and the socket 36 are all stationary relative to the slide body 10 and accordingly, the distance between the block or socket 36 and the grippers 12, 14 never varies under all conditions of operation. The socket 36 may be integrally formed with the slide body 10 in known manner to prevent separation or may be rigidly affixed thereto by conventional techniques such as welding, brazing or other permanent, secure affixation process.

The operating bolt or adjusting bolt 44 is longitudinally movable relative to the socket 36 and the permanently affixed slide body 10 between the attaching or detaching position 40 as illustrated in FIG. 3 to the door securing position 42 as illustrated in FIG. 4. It will be observed in FIGS. 1 and 2 that the adjusting bolt 44 comprises a forward cylindrical barrel portion 46 that is unthreaded and an integral, rearwardly positioned threaded section 48. The barrel portion 46 is fabricated of diameter of adequate size to provide suitable strength in operation and which is sufficiently small to slide longitudinally relative to the socket threaded section 38 in a relatively easy, unrestricted manner. The operating bolt threads 48 are of suitable size and pitch to threadedly engage the threaded section 38 of the integral socket 36 as hereinafter more fully set forth. In the preferred embodiment, the unthreaded section 46 is of greater length than the threaded section 48 to thereby facilitate rapid application of the device to a door and jamb assembly for locking purposes and to permit the rapid detachment of the device from the door and jamb when it is desired to open the door. In the preferred embodiment, the unthreaded section 46 can be approximately four inches in length and the threaded section 48 can be approximately one inch in length:

The adjusting bolt 44 terminates rearwardly in an operating handle or crank 50 of conventional design to facilitate turning the adjusting bolt 44 relative to the socket 36. A freely rotatable grip 52 of conventional design may be provided to facilitate rotation of the crank 50 if so desired.

The unthreaded section 46 of the adjusting bolt 44 terminates forwardly at the pressure plate 54 in a bearing connection 56 to permit the operating bolt 44 to be rotated relative to the pressure plate 54. By utilizing a suitable, known construction, such as an internal securing collar (not illustrated), the forward end 45 of the unthreaded section 46 is maintained in rotative association with the pressure plate 54 whereby the operating bolt 44 and the pressure plate 54 are movable respectively together forwardly and rearwardly between all longitudinally adjusted positions from full locking position or door securing position 42 (FIG. 4) to the attaching or detaching position 40 as shown in FIG. 3.

The pressure plate 54 comprises a strong, planar body 58 which is normally positioned at right angles to the longitudinal extent of the slide body 10. The pressure plate body 54 is fabricated to a generally rectangular configuration as illustrated and of sufficient dimensions to provide a firm bearing contact against the interior surface 60 of the door 20 to be secured in position. If desired, configurations other than rectangular may be employed provided sufficient bearing area remains to permit the door 20 to be secured in the locked position without damage to the door and to prevent unwanted opening of the door. The pressure plate includes a bottom-positioned slot 62 of dimensions to easily receive the slide body 10 therewithin in a sliding, substantially friction free engagement. A thin, strong toe plate 64 extends forwardly from the bottom terminus of the pressure plate body 58 and is integral therewith to prevent disassociation of the pressure plate 54 from the slide body 10 under all conditions and positions of use. As seen in FIGS. 4 and 5, the toe plate 64 terminates forwardly in a knife edge 66 of suitable strong, thin dimensions to easily fit within the space defined between the door edge 16 and the jambface 22, even when the door and jamb tightly fit. As illustrated, the toe plate tapers forwardly towards the knife edge 66 to provide a strong, thin construction to facilitate forward movement of the bolt 44 to the securing position 42 for maintaining the door 20 in a securely locked position.

In order to use the door fastener of the present invention, the crank 50 is rotated in a direction to unthread the threaded section 48 from engagement with the socket threads 38. Once free, the operating bolt 44 is then pulled rearwardly relative to the slide body 10 to the attaching or detaching position 40 as illustrated in FIG. 3. This pulls the attached pressure plate 54 rearwardly relative to the slide 10 until the pressure plate abuts the forward face 37 of the socket 36 which, in this instance, acts as the rearward limit of travel of the apparatus. The grippers 12, 14 are then inserted into the usual latch space or opening 28 defined by the strike plate 18 with the respective lock faces 32, 34 inwardly bearing against the metallic plate 18 at the periphery of the opening 30 defined therein. The door 20 is then urged to the closed position by grasping and pushing the usual door handle 68 as the device is pivoted about the connection between the lock faces 32, 34 and the strike plate 18 as necessary to permit the door edge 16 to close past the socket 36 and pressure plate 54.

The door 20 is then urged to its closed position thereby providing a clearance space between the forward face 70 of the pressure plate 54 and the interior surface 60 of the door. The operating bolt is then rapidly forwardly urged by pushing the unthreaded section 46 through the socket threads 38 without rotation of the crank 50 and without undue friction or binding until the forward edge 72 of the operating bolt threaded section 48 engages the threaded socket 38. A relatively small clearance space is then defined between the interior surface 60 of the door 20 and the pressure plate 54. This space will be variable depending upon the thickness of the door 20, for example, such space could be variable from usual interior door thicknesses of 1 and $\frac{1}{8}$ inches to the usual exterior door thickness of two inches. Then, by rotating the operating bolt 44 by turning the crank 50, the bolt threaded section 48 will be threadedly engaged upon the socket threads 38 to urge the adjusting bolt 44 and the connected pressure plate 54 forwardly toward the door 20. By turning the adjusting bolt 44 until the pressure plate 54 firmly contacts the interior door surface 60, the interaction between slide grippers 12, 14 which are retained by the strike plate 18 and the pressure plate 54 which is retained in position by the threaded engagement between the bolt threaded section 48 and the socket threads 38, combine to securely lock the door 20 in position. See FIG. 4. If desired, a soft covering or pad 74 can be glued or otherwise adhered to the pressure plate forward face 70 to prevent marking or other damage to the door surface 60.

In order to unlock the door 20, as illustrated in FIG. 3, the crank 50 is rotated in the direction to unthread the threaded section 48 of the adjusting bolt 44 within the threaded socket 36 to thereby urge the adjusting bolt 44 and the rotatively affixed pressure plate 54 rearwardly relative to the slide body 10 and away from the surface 60 of the door 20. The crank 50 is rotated until the adjusting bolt threads 48 completely disengage from the socket threads 38. Once the respective threads 48, 38 disengage, the entire adjusting bolt 44 and the affixed pressure plate 54 can be easily and rapidly pulled away from the door surface 60 to the rearward position as illustrated in FIG. 3. With the pressure plate 54 urged to its rearwardmost position, the slide 10 can be pivoted as necessary about the lock faces 32, 34 to permit the edge 16 of the door 20 to pivotally open past the pressure plate 54. After the door edge 16 has cleared the pressure plate 54, the slide can be easily removed from association with the strike plate 18 so that the parts are then completely clear.

As illustrated in FIG. 3, it will be noted that the door latch 26 contacts the surface of the slide body 10 and is depressed from its fully open position as illustrated in phantom lines as necessary to permit the door 20 to pivotally open and close relative to the slide body 10 during the locking and unlocking operation.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. In a portable door fastener of the type suitable to partially insert into the latch space of the door lock to lock a horizontally swinging door in closed position against its associated jamb, the combination of a slide body comprising a length of thin, strong material, said body including at least one forward gripper projection adapted to insert into the latch space;

a socket rearwardly affixed to the body in spaced relationship to the gripper, said socket including an integral, threaded section;

a pressure plate adapted to slide relative to the body, said pressure plate comprising a door contacting surface; and an operating bolt longitudinally movable through the socket, said operating bolt being adapted to forwardly carry the pressure plate in a rotative connection, said operating bolt comprising threaded and unthreaded portions, the unthreaded portion being adapted to move rapidly through the socket to either push the pressure plate toward the door or to pull the pressure plate away from the door, the threaded portion of the operating bolt being adapted to engage in the threaded section of the socket to urge the pressure plate against the door by utilizing the mechanical advantage of the screw threads, the threaded portion of the operating bolt being positioned at the bolt end which extends away from the pressure plate and the unthreaded portion of the operating bolt being positioned at the bolt end which forwardly carries the pressure plate, whereby the door fastener may be rapidly applied to and removed from a door for locking and unlocking purposes.

2. The door fastener of claim 1 wherein the handle is a crank and wherein the handle comprises a rotatable grip, the handle being adapted to rotate the threaded portion of the operating bolt within the threaded section of the socket and to longitudinally move the unthreaded portion of the operating bolt through the socket.

3. The door fastener of claim 2 wherein the handle is adapted to move the unthreaded portion of the operating bolt through the socket without rotation.

* * * * *